US011873696B1

(12) United States Patent
Acosta Villarreal et al.

(10) Patent No.: US 11,873,696 B1
(45) Date of Patent: Jan. 16, 2024

(54) STAGE CEMENTING TOOL

(71) Applicant: Halliburton Energy Services, Inc., Houston, TX (US)

(72) Inventors: Frank Vinicia Acosta Villarreal, Houston, TX (US); Saul Emmanuel Vazquez Niebla, Houston, TX (US); Ahmad Rizal Maharam, Senai (MY)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/870,470

(22) Filed: Jul. 21, 2022

(51) Int. Cl.
*E21B 33/14* (2006.01)

(52) U.S. Cl.
CPC ..... *E21B 33/146* (2013.01)

(58) Field of Classification Search
CPC ..... E21B 33/16; E21B 33/165; E21B 33/146
See application file for complete search history.

(56) References Cited

U.S. PATENT DOCUMENTS 3,358,770 A * 12/1967 Zandmer ..... E21B 34/063 137/543.13
3,417,822 A * 12/1968 Howell ..... E21B 31/03 175/320
3,789,926 A 2/1974 Henley et al.
3,948,322 A 4/1976 Baker
4,286,662 A * 9/1981 Page, Jr. ..... E21B 34/063 166/317
4,487,263 A 12/1984 Jani
4,674,569 A 6/1987 Revils et al.
4,842,062 A * 6/1989 Schneider ..... E21B 34/14 166/317
5,024,273 A 6/1991 Coone et al.
5,279,370 A 1/1994 Brandell et al.
5,368,098 A * 11/1994 Blizzard, Jr. ..... E21B 33/146 166/387
5,411,095 A 5/1995 Ehlinger et al.
5,443,124 A 8/1995 Wood et al.
5,647,434 A 7/1997 Sullaway et al.
5,765,641 A 6/1998 Shy et al.
6,026,903 A 2/2000 Shy et al.
6,244,342 B1 6/2001 Sullaway et al.
(Continued)

FOREIGN PATENT DOCUMENTS

EP 1262629 A1 12/2002
WO 2016118018 A1 7/2016
WO 2022132183 A1 6/2022

OTHER PUBLICATIONS

Halliburton Catalog titled "Casing Equipment" (2015), entire catalog.

(Continued)

*Primary Examiner* — Shane Bomar
(74) *Attorney, Agent, or Firm* — McAfee & Taft

(57) ABSTRACT

A stage cementing tool for a wellbore comprises a tool body defining a flow port in a wall thereof. The tool body and wellbore define an annulus therebetween. A setting sleeve compresses a packer element as it moves from the first to the second position. The packer element expands radially outwardly to engage the wellbore as a result of the compression applied by the setting sleeve. A pump-out plug in the tool body is expellable into the annulus upon the application of pressure in the tool body after the packer element engages the wellbore.

18 Claims, 6 Drawing Sheets

(56) References Cited

U.S. PATENT DOCUMENTS

| | | | | |
|---|---|---|---|---|
| 6,425,442 | B1 | 7/2002 | Latiolais, Jr. et al. | |
| 6,796,377 | B2 | 9/2004 | Butterfield, Jr. et al. | |
| 6,802,373 | B2 | 10/2004 | Dillenbeck et al. | |
| 7,237,611 | B2 | 7/2007 | Vincent et al. | |
| 7,857,052 | B2 | 12/2010 | Giroux et al. | |
| 7,866,402 | B2 | 1/2011 | Williamson, Jr. | |
| 8,215,404 | B2 | 7/2012 | Makowiecki et al. | |
| 8,616,276 | B2 | 12/2013 | Tips et al. | |
| 8,646,537 | B2 | 2/2014 | Tips et al. | |
| 8,720,561 | B2 | 5/2014 | Zhou | |
| 9,010,442 | B2 | 4/2015 | Streich et al. | |
| 9,121,255 | B2 | 9/2015 | Themig et al. | |
| 9,291,007 | B2 | 3/2016 | Darbe et al. | |
| 9,441,440 | B2 | 9/2016 | Hofman et al. | |
| 9,441,446 | B2 | 9/2016 | Fripp et al. | |
| 9,506,324 | B2 | 11/2016 | Kyle et al. | |
| 9,587,486 | B2 | 3/2017 | Walton et al. | |
| 9,816,351 | B2 | 11/2017 | Lirette et al. | |
| 9,856,714 | B2 * | 1/2018 | Giroux | E21B 33/146 |
| 9,920,620 | B2 | 3/2018 | Murphree et al. | |
| 10,024,150 | B2 | 7/2018 | Andreychuk et al. | |
| 10,030,472 | B2 * | 7/2018 | Fripp | E21B 43/12 |
| 10,316,619 | B2 | 6/2019 | de Oliveira et al. | |
| 10,358,914 | B2 | 7/2019 | Roberson et al. | |
| 10,557,329 | B2 | 2/2020 | Gao et al. | |
| 11,280,157 | B2 | 3/2022 | Acosta et al. | |
| 11,293,253 | B2 | 4/2022 | Santoso et al. | |
| 2006/0207765 | A1 | 9/2006 | Hofman | |
| 2007/0261850 | A1 | 11/2007 | Giroux et al. | |
| 2008/0251253 | A1 | 10/2008 | Lumbye | |
| 2009/0071655 | A1 | 3/2009 | Fay | |
| 2009/0151960 | A1 | 6/2009 | Rogers et al. | |
| 2010/0051276 | A1 | 3/2010 | Rogers | |
| 2010/0163253 | A1 | 7/2010 | Caldwell et al. | |
| 2013/0048290 | A1 | 2/2013 | Howell et al. | |
| 2013/0233570 | A1 | 9/2013 | Acosta et al. | |
| 2013/0233572 | A1 | 9/2013 | Helms et al. | |
| 2013/0312965 | A1 * | 11/2013 | Themig | E21B 34/14 166/135 |
| 2015/0027706 | A1 | 1/2015 | Symms | |
| 2015/0184489 | A1 | 7/2015 | Resweber | |
| 2016/0208577 | A1 * | 7/2016 | Byberg | E21B 33/128 |
| 2017/0145784 | A1 | 5/2017 | Zhou | |
| 2018/0320473 | A1 | 11/2018 | Xu et al. | |
| 2019/0017366 | A1 | 1/2019 | Alaas et al. | |
| 2019/0249549 | A1 | 8/2019 | Fripp et al. | |
| 2020/0270967 | A1 | 8/2020 | Fong et al. | |
| 2021/0010345 | A1 | 1/2021 | Acosta et al. | |

OTHER PUBLICATIONS

Halliburton Brochure, "Cementing ES II Stage Cementer," Feb. 2009.

Halliburton Brochure, "Fidelis Stage Cementer," Sep. 2013.

International Search Report and Written Opinion dated Apr. 5, 2021, in PCT Application No. PCT/US2020/053694.

International Search Report and Written Opinion dated Jun. 20, 2022, in PCT Application No. PCT/US2022/020696.

Halliburton Installation and Operating Instructions, OBSIDIO 9-5/8" Multiple Stage Mechanical Packer Collar, pp. 12, 13, 17 and 18, May 2021.

International Search Report and Written Opinion dated Sep. 20, 2023, issued in corresponding PCT Application No. PCT/US2023/024098.

* cited by examiner

STAGE CEMENTING TOOL

The field relates to a multi-stage cementing tool used in the oil and gas industry.

BRIEF DESCRIPTION OF THE DRAWINGS

FIG. 6 is a cross section of an exemplary pump-out plug.

DESCRIPTION OF AN EMBODIMENT

Figure 1:
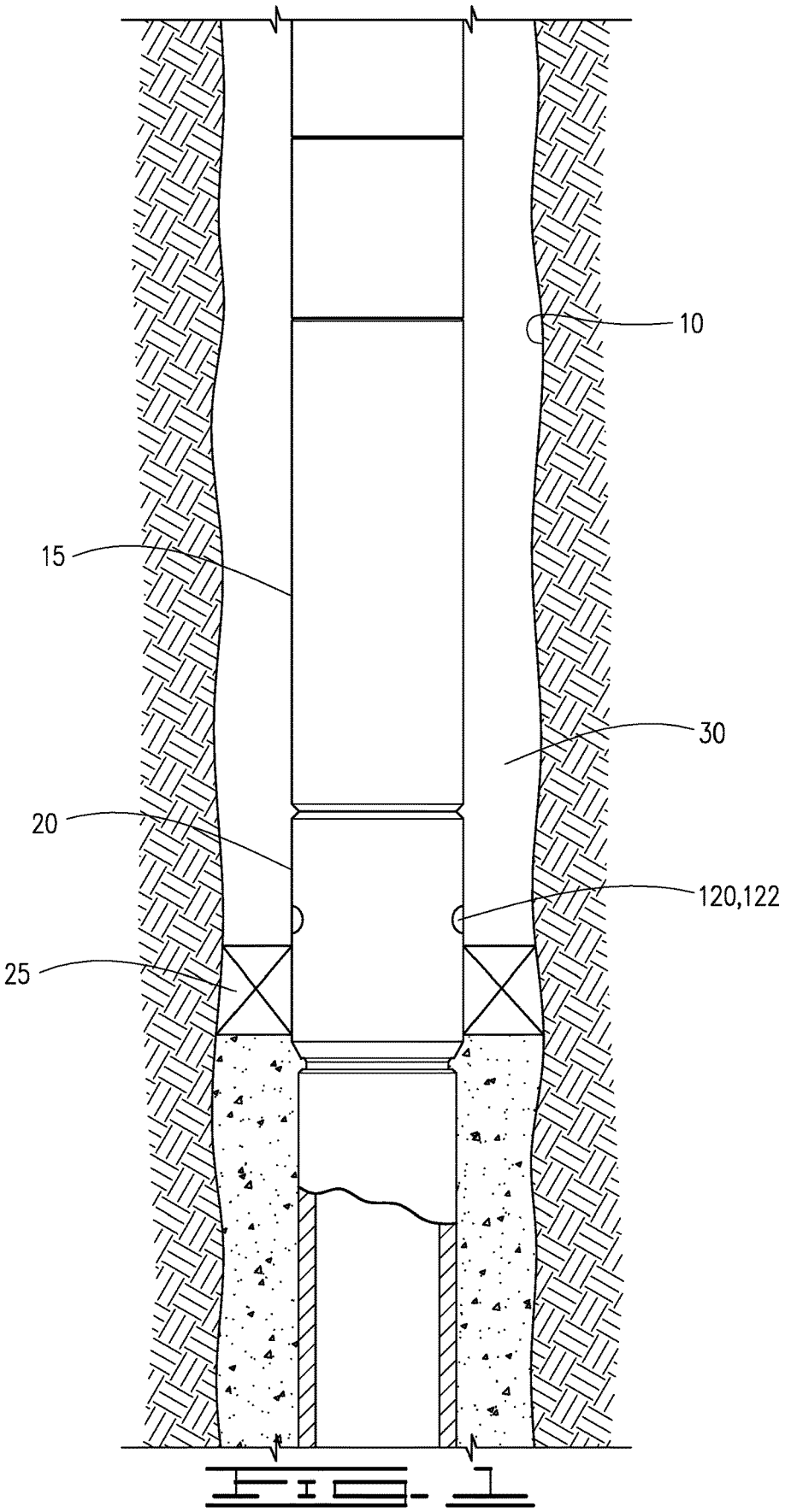
FIG. 1 is a schematic showing a casing with a multi-stage cementing tool in a wellbore.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally toward the surface; likewise, use of "down," "lower," "downward," "down-hole," "downstream," or other like terms shall be construed as generally away from the surface, regardless of the wellbore orientation. Use of any one or more of the foregoing terms shall not be construed as denoting positions along a perfectly vertical axis. A wellbore can include vertical, inclined or horizontal portions, and can be straight or curved.

During well completion, it is common to introduce a cement composition into an annulus in a wellbore. For example, in a cased-hole wellbore, a cement composition can be placed into and allowed to set in the annulus between the wellbore wall and the outside of the casing in order to stabilize and secure the casing in the wellbore. By cementing the casing in the wellbore, fluids are prevented from flowing into the annulus. Consequently, oil or gas can be produced in a controlled manner by directing the flow of oil or gas through the casing and into the wellhead. Cement compositions can also be used in primary or secondary cementing operations, well-plugging, or squeeze cementing.

As used herein, a "cement composition" is a mixture of at least cement and water. A cement composition can include additives. A cement composition is a heterogeneous fluid including water as the continuous phase of the slurry and the cement (and any other insoluble particles) as the dispersed phase. The continuous phase of a cement composition can include dissolved substances.

A spacer fluid can be introduced into the wellbore after the drilling fluid and before the cement composition. The spacer fluid can be circulated down through a drill string or tubing string and up through the annulus. The spacer fluid functions to remove the drilling fluid from the wellbore.

In cementing operations, a spacer fluid is typically introduced after the drilling fluid into the casing. The spacer fluid pushes the drilling fluid through the casing and up into an annular space towards a wellhead. A cement composition can then be introduced after the spacer fluid into the casing. There can be more than one stage of a cementing operation. Each stage of the cementing operation can include introducing a different cement composition that has different properties, such as density. A lead cement composition can be introduced in the first stage, while a tail cement slurry can be introduced in the second stage. Other cement compositions can be introduced in third, fourth, and so on stages.

A cement composition should remain pumpable during introduction into a wellbore. A cement composition will ultimately set after placement into the wellbore. As used herein, the term "set," with respect to a cement composition and all grammatical variations thereof, are intended to mean the process of becoming hard or solid by curing. As used herein, the "setting time" is the difference in time between when the cement and any other ingredients are added to the water and when the composition has set at a specified temperature. It can take up to 48 hours or longer for a cement composition to set. Some cement compositions can continue to develop compressive strength over the course of several days.

During first stage cementing operations, a first cement composition (e.g., a lead slurry) can be pumped from the wellhead, through the casing and a downhole tool that can include a float shoe or collar, out the bottom of the casing, and into an annulus towards the wellhead. At the conclusion of the first stage, a shut-off plug can be placed into the casing, wherein the plug engages with a restriction near the bottom of the casing such as a seat and closes a fluid flow path through the casing.

FIG. 1 shows apparatus 20, which in one embodiment is a stage cementing tool 20 lowered into a wellbore 10 on casing 15. Stage cementing tool 20 is designed for efficient use in shallow wells for example around 200 feet or less, and wells with low pressure and temperature, for example below 3000 psi and 200° F. While the stage cementing tool 20 is particularly suited for use in such wells, it may be used in deeper wells and wells with higher temperatures and pressures. A compression packer 25 on stage cementing tool 20 is designed to support a hydrostatic column of cement and uses only one plug to set the stage cementing tool 20. A minimum amount of drill out is needed after the use of the stage cementing tool 20 is complete as described herein.

Figure 2:
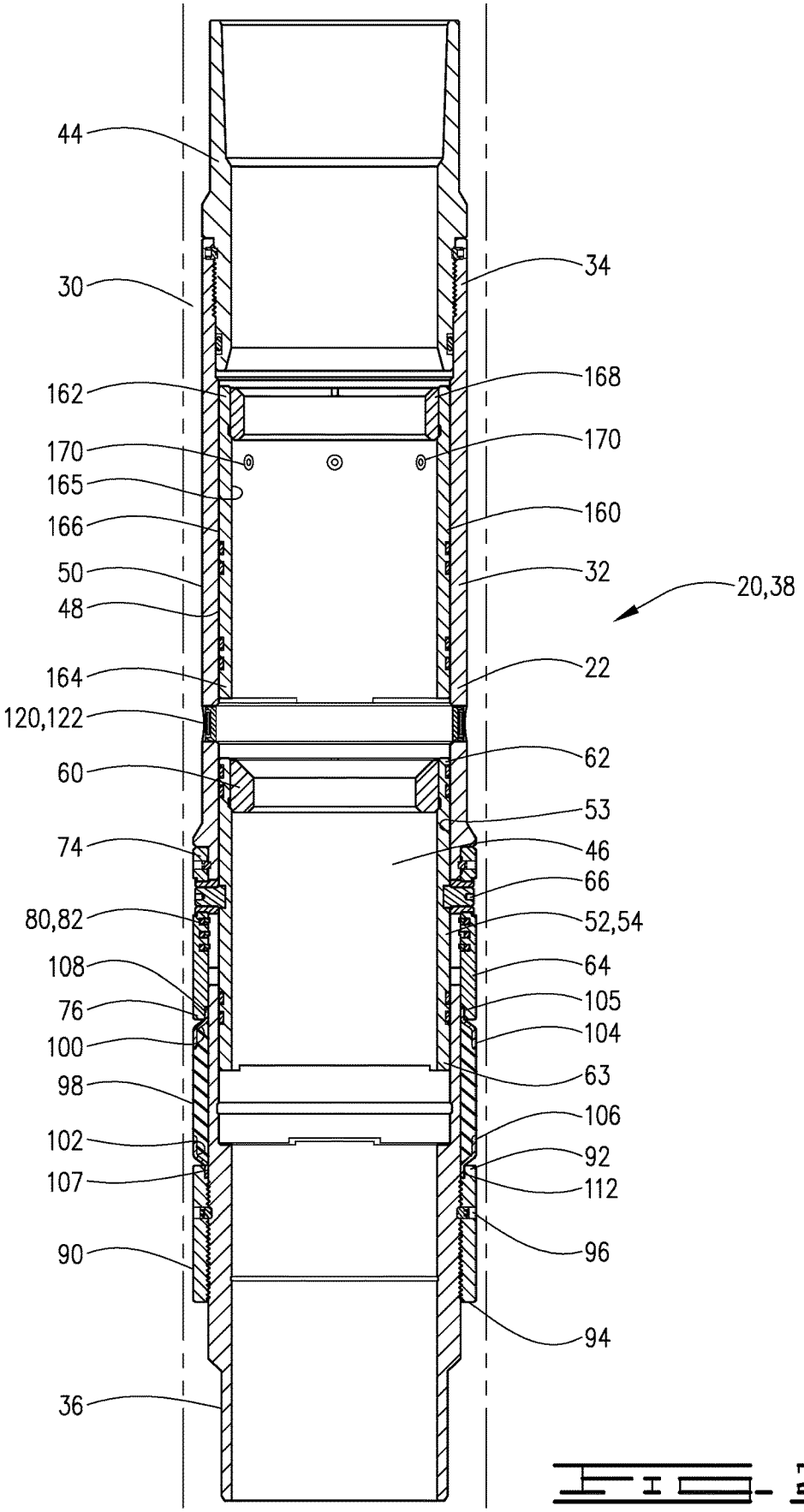
FIG. 2 is a cross section of the multi-stage cementing tool packer in a run-in position.
Figure 3:
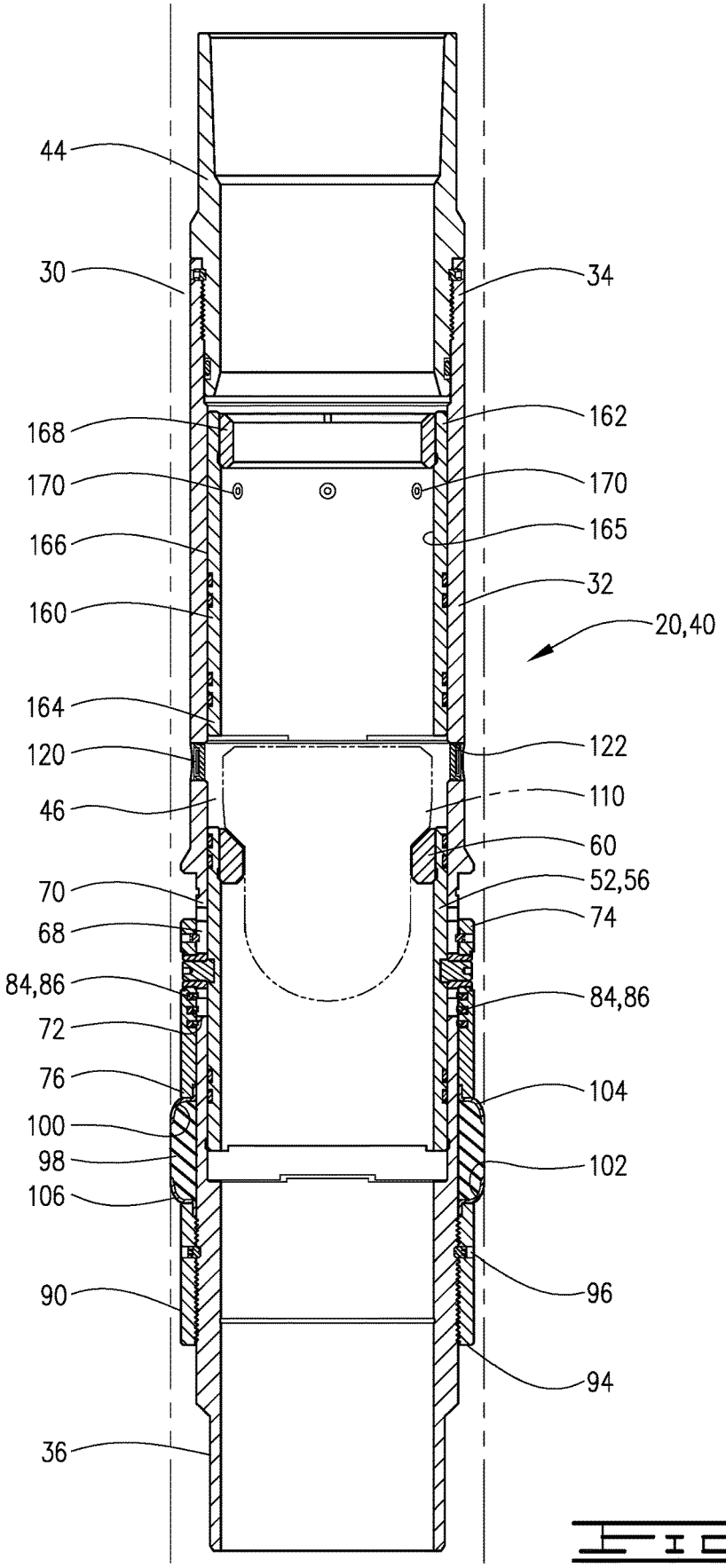
FIG. 3 is a cross section of the multi-stage cementing tool after it has been moved to a set position.

An annulus 30 is defined by and between stage cementing tool 20 and wellbore 10. Although depicted in an uncased wellbore 10, it is understood that use of the stage cementing tool 20 is not so limited, and may be used in a cased wellbore. Likewise, although the schematic in FIG. 1 shows use in a vertical wellbore, it is understood that apparatus 20 can be used in deviated and horizontal wellbores. Stage cementing tool 20 comprises a tool body 32 with upper end 34 and lower end 36. Stage cementing tool 20 is shown in a first, or run-in position 38 in FIG. 2. Stage cementing tool 20 is shown in a second, or set position 40 in FIG. 3 and in a third, or cementing position 42 in FIG. 4. A fourth position of stage cementing tool 20 is shown in FIG. 5, and is a closed, or completed position 43. An adapter 44 may be connected at upper end 34 of tool body 32 to connect in casing string 15. Stage cementing tool 20 defines a central flow passage 46 therethrough. Tool body 32 has inner surface 48 and exterior, or outer surface 50.

A sliding sleeve 52 is slidably disposed in tool body 32. Sliding sleeve 52 has an outer surface 53 that is sealingly received in tool body 32. Sliding sleeve 52 is shown in a first position 54 in FIG. 1, which corresponds to the run-in position 38 of the stage cementing tool 20, a second position 56 in FIG. 2 which corresponds to the set position 40, and a third position 58 in FIG. 4, which corresponds to the cementing position 42 of stage cementing tool 20. Sliding sleeve 52 stays in its third position 58 when stage cementing tool 20 is in the closed position 43. Sliding sleeve 52 has upper end 62 and lower end 63. A setting plug seat 60 is defined at upper end 62 of sliding sleeve 52. Setting plug seat 60 may be a separate piece connected to sliding sleeve 52 or may be integrally formed on sliding sleeve 52.

A setting sleeve 64 is disposed about tool body 32 and is slidable thereon. Setting sleeve 64 is connected to sliding sleeve 52 with frangible connectors, which may be for example shearable drive pins 66. Slots 68 with upper end 70 and lower end 72 are defined in tool body 32. Setting sleeve 64 has upper end 74 and lower end 76. Lower end 76 is a flat, or snub-nosed end 76, which may be described as a flat annular face.

A plurality of locking elements 80 are disposed in grooves 82 in setting sleeve 64. Locking elements in one embodiment may comprise lock rings 84 and a biasing element 86, which may comprise a wave spring that biases a lock ring 84 toward tool body 32.

A packer stop 90 is attached to tool body 32 and may be threaded thereto. Packer stop 90 has upper end 92 and lower end 94. Upper end 92 is a flat, snub nosed stop 92, which may be described as a flat annular face. Lock screws 96 may also be used to hold packer stop 90 in place. A packer element 98 is disposed about tool body 32 and has upper and lower ends 100 and 102 respectively.

An upper anti-extrusion element 104 covers upper end 100 of packer element 98 and has an upwardly extending leg 105. Leg 105 encircles tool body 32 above packer element 98. A lower anti-extrusion element 106 covers lower end 102 of packer element 98 and has a downwardly extending leg 107. Leg 107 encircles tool body 32 below packer element 98. An annular space 108 is defined by and between setting sleeve 64 and tool body 32 at the lower end 76 of setting sleeve 64. Leg 105 is positioned in space 108, and is captured between tool body 32 and setting sleeve 64 at lower end 76 thereof. An annular space 112 is defined by and between packer stop 90 at the upper end 92 of packer stop 90. Leg 107 is positioned in space 112, and is captured between tool body 32 and packer stop 90 at upper end 92 thereof.

Pump-out plugs 120 are positioned in ports 122 in a wall 22 of stage cementing tool 20, and in the described embodiment in tool body 32. Apparatus 20 will have at least one pump-out plug 120, and in the embodiment shown includes a plurality of pump-out plugs 120. As many as four pump-out plugs 120 may be used, although two are normally sufficient to provide redundancy. Central flow passage 46 is communicated with annulus 30 through port 122 when pump out-plug 120 is expelled into annulus 30. Port 122 in one embodiment has a first, cylindrical portion 124 that defines an inner diameter 126. A second portion 128 of port 122 tapers inwardly from first portion 124 and defines an inner diameter 130 that is smaller than diameter 126. Pump out plug 120 is sealingly received in port 122. Second portion 128 defines a sloped shoulder 129 against which pump-out plug 120 will abut, to prevent pressure in annulus 30 from pushing plug 120 into central flow passage 46.

Plug 120 comprises a first generally cylindrical portion 132 received in cylindrical portion 124 of port 122, and a second tapered portion 134 that is tapered inwardly from first portion 132. First portion 132 has an outer diameter 136, and may be referred to as a plug body. Second portion 134 may be referred to as a plug head. Plug head 134 will engage sloped shoulder 129 as described above. A seal 140, which may be an O-ring seal, is received in a groove 141 and sealingly engages port 122. Plug 120 may be retained in port 122 by a frangible retainer, which may be for example a retaining ring, shear pin or other frangible retainer. In the embodiment of FIG. 5, a retaining ring 142 is received in groove 144 in wall 22 and groove 148 in pump-out plug 120. Retaining ring 142 detachably connects plug 120 to tool body 20 and will prevent the pump-out plug 120 from being expelled into annulus 30 prematurely. Retaining ring 142 will also aid in preventing the pump out plug 120 from being pushed into central flow passage 46 due to pressure in the annulus 30. The engagement of plug head 134 with sloped shoulder 129 of port 122 will in any event prevent plug 120 from being pushed into central flow passage 46 as a result of pressure in the annulus 30. Other configurations for pump out plug 120 and port 122 are possible, and the configuration described here is but one embodiment. Rupture disks may also be used for the same purpose as the pump-out plug 120.

A closing sleeve 160 has upper end 162, lower end 164, inner surface 165 and outer surface 166. Closing sleeve 160 is sealingly received in tool body 32. Closing sleeve 160 has closing seat 168 at upper end 162 thereof. Closing sleeve 160 is detachably connected in tool body 32 with frangible pins 170. Pins 170 may be shear pins configured to break at a predetermined pressure. Flow ports 122 with pump-out plugs 120 therein are positioned between lower end 164 of closing sleeve 162 and upper end 62 of sliding sleeve 52 in the run-in position of apparatus 20.

In operation, the apparatus 20 is lowered into a wellbore on casing string 15. In a first stage, or the stage prior to the stage to be completed through flow ports 122, a cement composition will be pumped though casing 15 and into annulus 30 through a lower end of casing 15, or through ports below ports 122. At the conclusion of the first, or prior stage, a shutoff plug may be pumped into the casing 15. The schematic in FIG. 1 shows cement in annulus 30 below stage cementing tool 20. As previously noted, stage cementing tool 20 is shown in a vertical wellbore, but may be used in deviated or horizontal wellbores as well.

Apparatus 20 may be moved to the set position of the apparatus 20 in which packer element 98 is expanded radially outwardly to engage wellbore 10, which in the embodiment described is an uncased wellbore, but which may also be a cased wellbore. Packer element 98 is moved outwardly solely by placing the packer element 98 in compression, as opposed to using inflation, or the use of wedges and ramps which are commonly used to expand packer elements in other packer tools. Apparatus 20 is moved to the set position with the use of a setting plug 110.

Setting plug 110 is passed into casing 15 and will be moved downwardly therein until setting plug 110 engages setting plug seat 60. Once setting plug 110 engages setting plug seat 60, pressure is increased to move sliding sleeve 52 downwardly in tool body 32. Setting sleeve 64 will move downwardly with sliding sleeve 52 since setting sleeve 64 and sliding sleeve 52 are connected with frangible drive pins 66. Pressure is continuously applied so that setting sleeve 64 is pushed into packer element 98.

Compression is applied to packer element 98 by the annular flat face at the lower end 76 of setting sleeve 64 to the upper end 100 of packer element 98. Packer stop 90 is fixed to tool body 32 and is stationary. Packer element 98 is prevented from moving downward by the annular flat upper face at the upper end 92 of packer stop 90. Compression is applied to packer 98 until it expands radially outwardly sufficiently to move to the set position 40 in which packer element 98 engages and seals against wellbore 10. Locking elements 80 are biased toward tool body 32, and will be urged into grooves in the tool body 32 to hold setting sleeve 64 in place in its set position.

Pressure is applied in casing 15 until a sufficient pressure, which may be a predetermined pressure, is reached to apply a force to drive pins 66 that is sufficient to break the frangible drive pins 66. Once drive pins 66 are broken, sliding sleeve 52 will move downwardly in tool body 32 to the position shown in FIG. 4. Setting sleeve 64 is fixed to tool body 32 with locking elements 80 such that it maintains compression on packer element 98 to keep the apparatus 20 in its set position. No ramps or wedges are used to expand packer element 98, and the radial expansion of packer element 98 is caused solely by the compassion applied by setting sleeve 64.

Upper anti-extrusion element 104 captures upper end 100 of packer element 98 so that packer element 98 does not extrude around setting sleeve 64, and does not intrude into any gaps that may exist between setting sleeve 64 and tool body 32. Leg 105 of anti-extrusion element 104 occupies the space defined between setting sleeve 64 and tool body 32 to prevent the packer element 98 from intruding, or squeezing into that space. Lower anti-extrusion element 106 captures lower end 102 of packer element 98 so that packer element 98 does not extrude around packer stop 90, and does not intrude into any gaps that may exist between packer stop 90 and tool body 32. Leg 107 of anti-extrusion element 106 occupies the space defined between packer stop 90 and tool body 32 to prevent the packer element 98 from intruding, or squeezing into that space.

Figure 4:
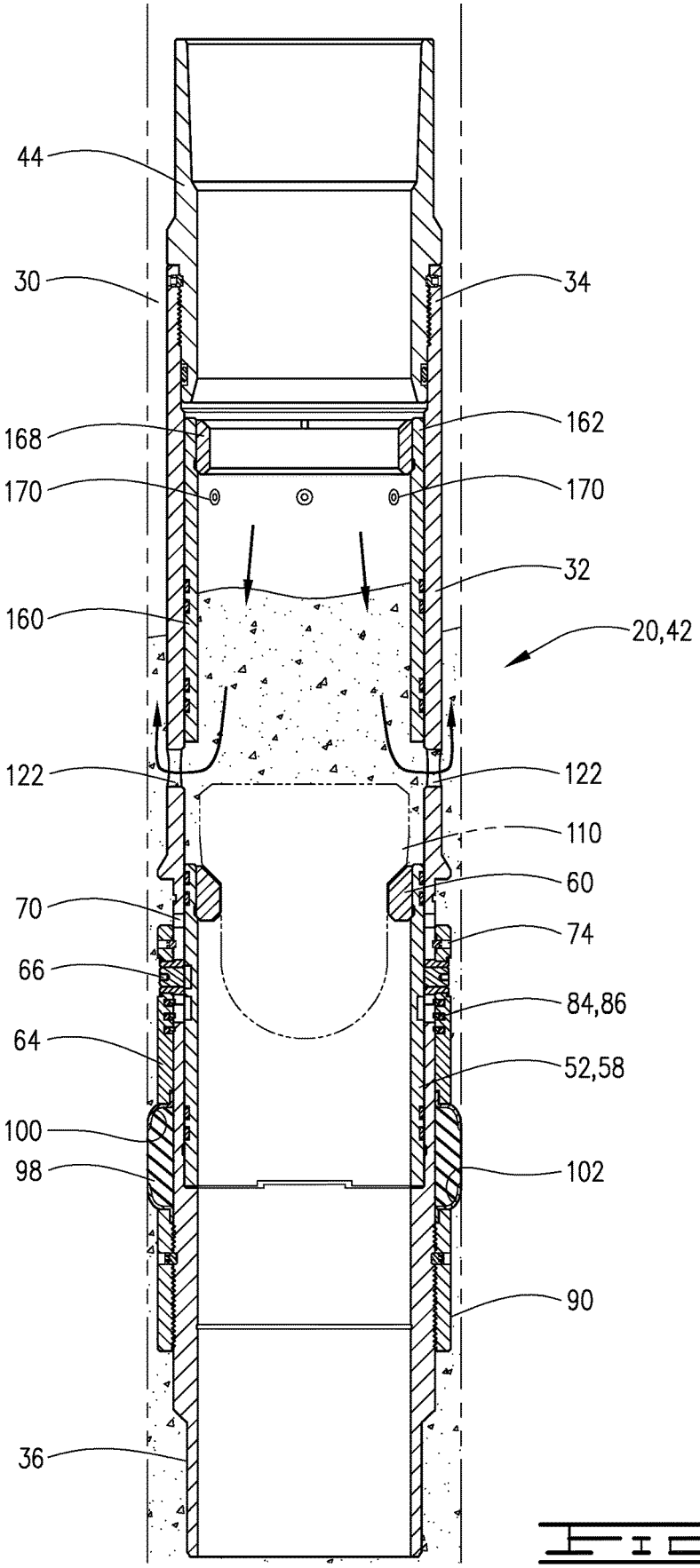
FIG. 4 is a cross section of the multi-stage cementing tool after it has been moved to a cementing position.
Figure 5:
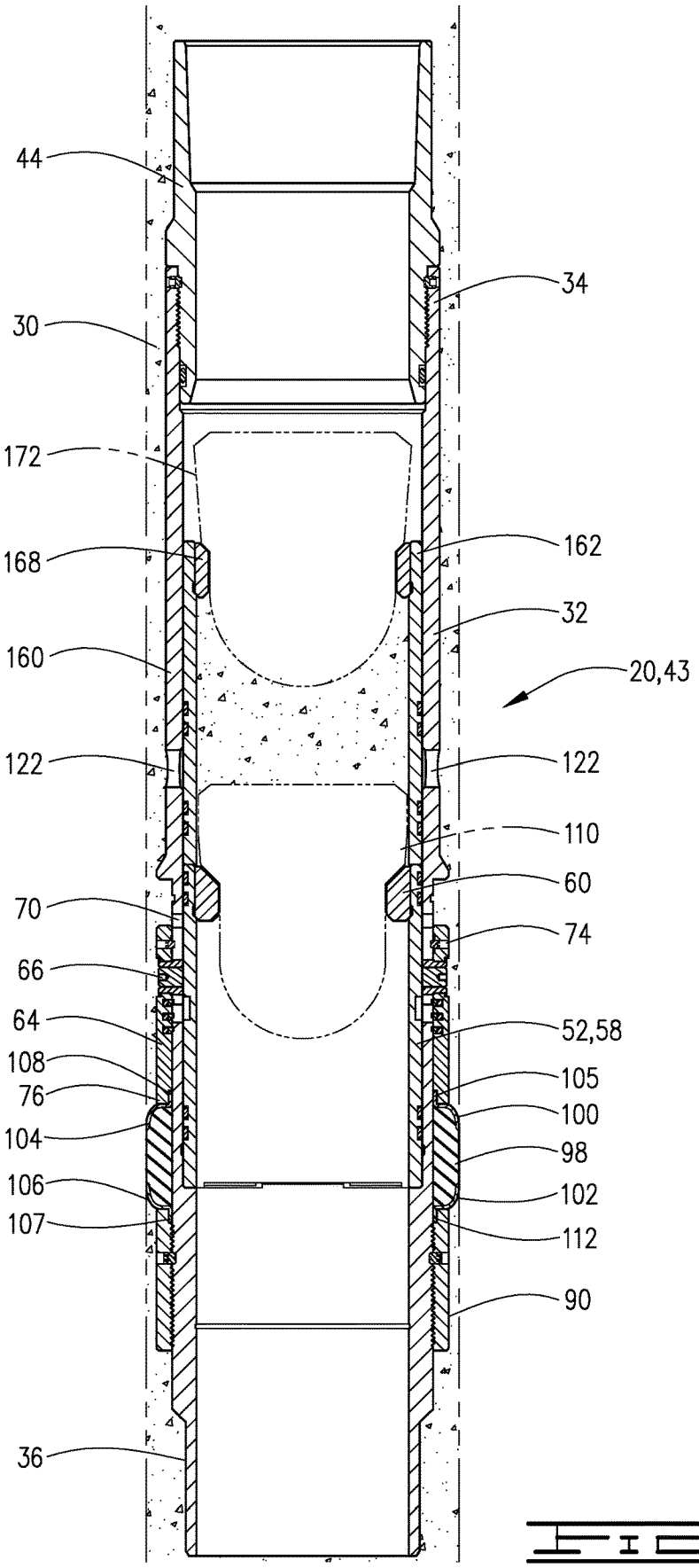
FIG. 5 is a cross section of the multi-stage cementing tool after it has been moved to a finished position.
Figure 5:
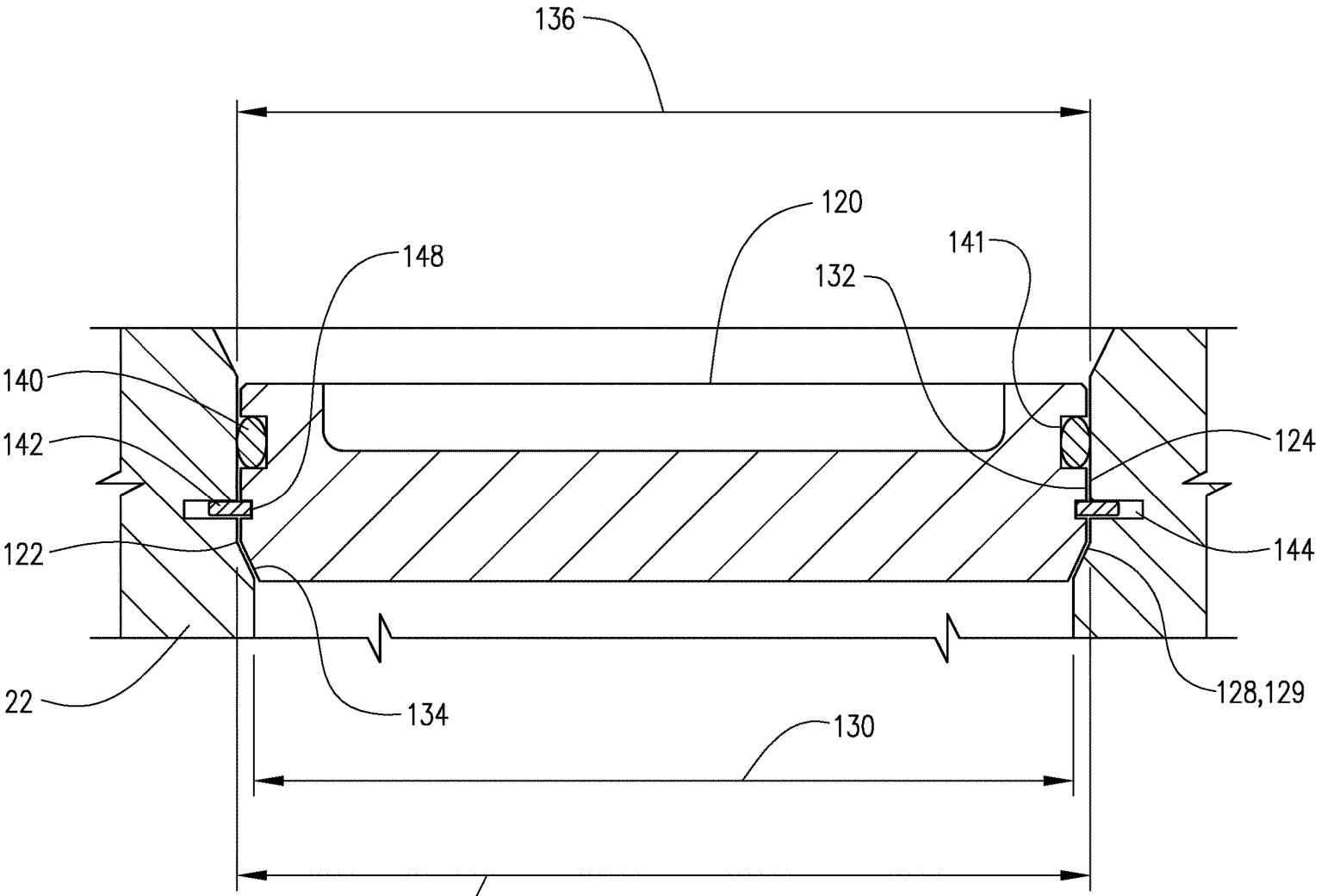

Once sliding sleeve 52 is moved to the position shown in FIG. 4, apparatus 20 is in the cementing position 42 and pressure may be increased to a pressure, which may be a predetermined pressure, that will generate a sufficient force applied to plugs 120 to break retaining rings 142. Pump-out plugs 120 will then be expelled into annulus 30, and a cement composition or other fluid may be delivered into annulus 30 through ports 122. As many as four pump-out plugs 120 may be used, although two are normally sufficient to provide redundancy. Once the delivery of the cement composition, or other fluid is complete, closing sleeve 160 can be moved from its first position shown in FIG. 2 to a second position shown in FIG. 5 in which closing sleeve 160 prevents flow between annulus 30 and central flow passage 46 through flow ports 122.

Closing sleeve 160 is moved to its second position with a closing plug 172 that is dropped through casing 15. Closing plug 172 will engage closing seat 168, and pressure thereabove is increased until a sufficient force is applied to frangible pins 170 to break the pins 170 and detach closing sleeve 160 from tool body 32 so that it may move downwardly to the position shown in FIG. 5, which is the completed position of apparatus 20.

Embodiments Include:

Embodiment 1. A stage cementing tool for a wellbore comprising: a tool body defining a flow port in a wall thereof, the tool body and wellbore defining an annulus therebetween; a pump-out plug positioned in the flow port; a radially expandable packer element disposed about the tool body; and a setting sleeve movable on the tool body from a first to a second position, wherein the setting sleeve compresses the packer element as it moves from the first to the second position, the packer element expanding radially outwardly to engage the wellbore solely as a result of the compression applied by the setting sleeve and wherein the pump-out plug is expellable into the annulus upon the application of pressure in the tool body after the packer element engages the wellbore.

Embodiment 2. The stage cementing tool of embodiment 1 further comprising a sliding sleeve disposed in the tool body and connected to the setting sleeve with frangible connectors, the sliding sleeve defining a setting plug seat; and a setting plug engaged with the setting plug seat, the sliding sleeve movable in the tool body upon the application of pressure above the setting plug, the setting sleeve movable downwardly with the sliding sleeve Embodiment 3. The stage cementing tool of either of embodiments 1 or 2, wherein pressure is increased in the tool body until the pump-out plug is expelled into the annulus after the packer element engages the wellbore.

Embodiment 4. The stage cementing tool of any of embodiments 1-3, further comprising a closing sleeve detachably connected in the tool body, the pump-out plug positioned between a lower end of the closing sleeve and an upper end of the sliding sleeve in a first position of the stage cementing tool.

Embodiment 5. The stage cementing tool of embodiment 4, the closing sleeve movable in the tool body from a first position in which the flow port is not covered by the closing sleeve to a second position in which the closing sleeve prevents flow from a central flow passage of the stage cementing tool to the annulus.

Embodiment 6. The cementing tool of any of embodiments 1-5, further comprising a packer stop connected to the tool body below the packer element.

Embodiment 7. The stage cementing tool of embodiment 6, a lower end of the setting sleeve and an upper end of the packer stop comprising flat annular faces.

Embodiment 8. A downhole tool in a wellbore comprising a tool body, the tool body and wellbore defining an annulus therebetween; a packer element disposed about the tool body; a packer stop disposed about the tool body below the packer element, the packer stop having an annular flat face above the packer element; a setting sleeve disposed about the tool body, the setting sleeve having a lower end defining an annular flat face and movable from a first position on the tool body to a second position on the tool body, wherein in the second position the packer element is compressed between the packer stop and the setting sleeve to radially expand the packer element; and a pump-out plug received in a flow port in the tool body, the pump-out plug being expellable into the annulus upon the application of pressure in the tool body, Embodiment 9. The downhole tool of embodiment 8 further comprising a sliding sleeve disposed in the tool body and connected to the setting sleeve, the setting sleeve movable with the sliding sleeve.

Embodiment 10. The downhole tool of either of embodiments 8 or 9 further comprising an upper anti-extrusion ring capturing an upper end of the packer element, a portion of the anti-extrusion ring being trapped between the setting sleeve and the tubular body to prevent the packer element from intruding between the setting sleeve and the tubular body.

Embodiment 11. The downhole tool of any of embodiments 8-10 further comprising a lower anti-extrusion ring capturing a lower end of the packer element, a portion of the anti-extrusion ring being trapped between the packer stop and the tubular body to prevent the packer element from intruding between the packer stop and the tubular body Embodiment 12. The downhole tool of any of embodiments 8-11 further comprising a closing sleeve detachably connected in the tool body above the pump-out plug and movable in the tool body to cover the port in the tool body after the pump-out plug has been expelled into the annulus.

Embodiment 13. The downhole tool of any of embodiments 8-12, further comprising a frangible retainer detachably connecting the pump-out plug to the tool body.

Embodiment 14. A method of cementing a casing in a wellbore comprising: conveying a cementing tool into the wellbore on a casing, the cementing tool comprising: a tool body; a compressible packer element disposed about the tool body; a pump-out plug disposed in a port defined in a wall of the tool body; a setting sleeve disposed about the tool body above the packer element; a closing sleeve disposed in the tool body; and a packer stop disposed on the tool body below the packer element; squeezing the compressible packer element between a lower end of the setting sleeve and an upper end of the packer stop to radially expand the packer element; expelling the pump-out plug into an annulus between the tool body and the wellbore after the packer element has been expanded; and pumping a cementitious composition from the central flow passage of the tool body into the annulus through the flow port.

Embodiment 15. The method of embodiment 14 wherein the lower end of the setting sleeve defines a flat annular face.

Embodiment 16. The method of either of embodiments 14 or 15 further comprising detaching the closing sleeve from the tool body; and blocking flow through the flow port with the closing sleeve after a desired amount of the cementitious mix has been flowed into the annulus.

Embodiment 17. The method of any of embodiments 14-16 further comprising a sliding sleeve disposed in the tool body and connected to the setting sleeve, the method further comprising engaging the sliding sleeve with a setting plug; and increasing the pressure in the casing to urge the sliding sleeve downwardly, the setting sleeve moving downwardly with the sliding sleeve to squeeze the compressible packer element.

Embodiment 18. The method of embodiment 17 further comprising delivering a closing plug into the casing; engaging the closing sleeve with the closing plug; detaching the closing sleeve from the tool body; and covering the flow port with the closing sleeve.

Embodiment 19. The method of any of embodiments 14-18, the lower end of the setting sleeve comprising a flat annular face and the upper end of the packer stop comprising a flat annular face.

Embodiment 20. The method of any of embodiments 14-19, the squeezing step comprising moving the setting sleeve from a first to a second position on the tool body, the method further comprising locking the setting sleeve in the second position.

Therefore, the apparatus, methods, and systems of the present disclosure are well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present disclosure.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more cement compositions, flow ports, etc., as the case may be, and do not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A stage cementing tool for a wellbore comprising:

a tool body defining a flow port in a wall thereof, the tool body and wellbore defining an annulus therebetween;

a pump-out plug positioned in the flow port;

a radially expandable packer element disposed about the tool body; and a setting sleeve movable on the tool body from a first to a second position, wherein the setting sleeve compresses the packer element as it moves from the first to the second position, the packer element expanding radially outwardly to engage the wellbore solely as a result of the compression applied by the setting sleeve and wherein the pump-out plug is expellable into the annulus upon the application of pressure in the tool body after the packer element engages the wellbore;

a sliding sleeve disposed in the tool body and connected to the setting sleeve with frangible connectors, the sliding sleeve defining a setting plug seat; and a setting plug engaged with the setting plug seat, the sliding sleeve movable in the tool body upon the application of pressure above the setting plug, the setting sleeve movable downwardly with the sliding sleeve.

2. The stage cementing tool of claim 1, wherein pressure is increased in the tool body until the pump-out plug is expelled into the annulus after the packer element engages the wellbore.

3. The stage cementing tool of claim 1, further comprising a closing sleeve detachably connected in the tool body, the pump-out plug positioned between a lower end of the closing sleeve and an upper end of the sliding sleeve in a first position of the stage cementing tool.

4. The stage cementing tool of claim 3, the closing sleeve movable from in the tool body from a first position in which the flow port is not covered by the closing sleeve to a second position in which the closing sleeve prevents flow from a central flow passage of the stage cementing tool to the annulus.

5. The stage cementing tool of claim 1, further comprising a packer stop connected to the tool body below the packer element.

6. The stage cementing tool of claim 5, a lower end of the setting sleeve and an upper end of the packer stop comprising flat annular faces.

7. A downhole tool in a wellbore comprising:

a tool body, the tool body and wellbore defining an annulus therebetween;

a packer element disposed about the tool body;

a packer stop disposed about the tool body below the packer element, the packer stop having an annular flat face above the packer element;

a setting sleeve disposed about the tool body, the setting sleeve having a lower end defining an annular flat face and movable from a first position on the tool body to a second position on the tool body, wherein in the second position the packer element is compressed between the packer stop and the setting sleeve to radially expand the packer element; and a pump-out plug received in a flow port in the tool body, the pump-out plug being expellable into the annulus upon the application of pressure in the tool body.

8. The downhole tool of claim 7 further comprising a sliding sleeve disposed in the tool body and connected to the setting sleeve, the setting sleeve movable with the sliding sleeve.

9. The downhole tool of claim 7 further comprising an upper anti-extrusion ring capturing an upper end of the packer element, a portion of the anti-extrusion ring being trapped between the setting sleeve and the tool body to prevent the packer element from intruding between the setting sleeve and the tool body.

10. The downhole tool of claim 9 further comprising a lower anti-extrusion ring capturing a lower end of the packer element, a portion of the anti-extrusion ring being trapped between the packer stop and the tool body to prevent the packer element from intruding between the packer stop and the tool body.

11. The downhole tool of claim 7 further comprising a closing sleeve detachably connected in the tool body above the pump-out plug and movable in the tool body to cover the port in the tool body after the pump-out plug has been expelled into the annulus.

12. The downhole tool of claim 7 further comprising a frangible retainer detachably connecting the pump-out plug to the tool body.

13. A method of cementing a casing in a wellbore comprising:

conveying a cementing tool into the wellbore on a casing, the cementing tool comprising:

a tool body;

a compressible packer element disposed about the tool body;

a pump-out plug disposed in a flow port defined in a wall of the tool body;

a setting sleeve disposed about the tool body above the packer element wherein the lower end of the setting sleeve defines a flat annular face;

a closing sleeve disposed in the tool body; and a packer stop disposed on the tool body below the packer element;

squeezing the compressible packer element between a lower end of the setting sleeve and an upper end of the packer stop to radially expand the packer element;

expelling the pump-out plug into an annulus between the tool body and the wellbore after the packer element has been expanded; and pumping a cement composition from the central flow passage of the tool body into the annulus through the flow port.

14. The method of claim 13, further comprising:

detaching the closing sleeve from the tool body; and blocking flow through the flow port with the closing sleeve after a desired amount of the cement composition has been flowed into the annulus.

15. The method of claim 13 further comprising a sliding sleeve disposed in the tool body and connected to the setting sleeve, the method further comprising:

engaging the sliding sleeve with a setting plug; and increasing the pressure in the casing to urge the sliding sleeve downwardly, the setting sleeve moving downwardly with the sliding sleeve to squeeze the compressible packer element.

16. The method of claim 15 further comprising:

delivering a closing plug into the casing;

engaging the closing sleeve with the closing plug;

detaching the closing sleeve from the tool body; and covering the flow port with the closing sleeve.

17. The method of claim 13, the upper end of the packer stop comprising a flat annular face.

18. The method of claim 13, the squeezing step comprising moving the setting sleeve from a first to a second position on the tool body, the method further comprising locking the setting sleeve in the second position.

* * * * *